US006315441B2

(12) United States Patent
King

(10) Patent No.: US 6,315,441 B2
(45) Date of Patent: Nov. 13, 2001

(54) MIXING DEVICE WITH VANES HAVING SLOPING EDGES AND METHOD OF MIXING VISCOUS FLUIDS

(76) Inventor: Ronnald B. King, 3405 S. Manito Blvd., Spokane, WA (US) 99203

( * ) Notice: Subject to any disclaimer, the term of this patent is extended or adjusted under 35 U.S.C. 154(b) by 0 days.

(21) Appl. No.: 09/821,540

(22) Filed: Mar. 28, 2001

Related U.S. Application Data

(6263) Continuation of application No. 09/505,225, filed on Feb. 16, 2000, now Pat. No. 6,286,989, which is a continuation-in-part of application No. 09/091,145, filed as application No.PCT/US96/19345 on Dec. 5, 1996, now Pat. No. 6,062,721, which is a continuation of application No. 08/567,271, filed on Dec. 5, 1995, now abandoned.

(51) Int. Cl.[7] ..... B01F 5/12; B01F 7/32

(52) U.S. Cl. ..... 366/129; 366/265; 366/317; 366/605

(58) Field of Search ..... 366/129, 130, 366/262, 263, 265, 270, 315–317, 342, 343, 348, 605; 416/178, 184, 187

(56) References Cited

U.S. PATENT DOCUMENTS

| | | |
|---|---|---|
| 59,493 | 11/1866 | Willcox . |
| 1,067,007 | 7/1913 | Douglas . |
| 1,084,210 | 1/1914 | Howard . |
| 1,765,386 | 6/1930 | Wait . |
| 1,908,002 | 5/1933 | Valentine . |
| 2,226,470 | 12/1940 | McGuffee . |
| 2,230,146 | 1/1941 | Myers . |
| 2,520,540 | 8/1950 | Green . |
| 2,724,547 | 11/1955 | Abbott et al. . |
| 2,803,398 | 8/1957 | Sprouse . |
| 2,879,044 | 3/1959 | Gunas . |
| 3,166,303 | 1/1965 | Chapman . |
| 3,319,940 | 5/1967 | Mentnech . |
| 3,362,689 | 1/1968 | Rothman et al. . |
| 3,423,075 | 1/1969 | Knudsen et al. . |
| 3,464,622 | 9/1969 | Dennis . |
| 3,521,973 | 7/1970 | Schouw . |
| 3,690,621 | 9/1972 | Tanaka . |
| 3,733,645 | 5/1973 | Seiler . |
| 3,846,043 | 11/1974 | Wolbrink et al. . |
| 3,972,512 | 8/1976 | Grise et al. . |
| 4,175,875 | 11/1979 | Van Horbek . |
| 4,472,063 | 9/1984 | Eickelmann . |
| 4,483,624 | 11/1984 | Bacon, Jr. et al. . |
| 4,538,922 | 9/1985 | Johnson . |
| 4,738,593 | 4/1988 | Reifschneider . |
| 4,893,941 | 1/1990 | Wayte . |
| 4,900,159 | 2/1990 | Jamison . |
| 4,948,262 | 8/1990 | Tome, Jr. . |
| 5,073,033 | 12/1991 | Klepeis . |
| 5,251,979 | 10/1993 | Larsen . |

(List continued on next page.)

FOREIGN PATENT DOCUMENTS

| | | |
|---|---|---|
| 2225800 | 7/1980 | (DE) . |
| 1064111 | 4/1967 | (GB) . |
| WO 97/20623 | 6/1997 | (WO) . |

*Primary Examiner*—Charles E. Cooley
(74) *Attorney, Agent, or Firm*—Weide & Associates, Ltd

(57) ABSTRACT

The present invention is a mixing device and a method of mixing viscous fluids with a mixing device. The mixing device includes a shaft and a support mounted for rotation with the shaft. A plurality of vanes extend from the support and are mounted for rotation with the shaft, the vanes extending generally parallel to the shaft and positioned radially outward from the shaft. The vanes have a sloping inner edge which is positioned closer to the shaft at a first portion of the vane than a second portion of the vane. In use, the mixing device is located in a viscous fluid and the shaft is rotated, thereby effecting rotation of the vanes, causing fluid to move through the vanes and mix the fluid.

23 Claims, 5 Drawing Sheets

U.S. PATENT DOCUMENTS

| | | | |
|---|---|---|---|
| 5,314,310 | | 5/1994 | Bachellier . |
| 5,417,493 | | 5/1995 | Ericson . |
| 5,865,539 | | 2/1999 | Rogers . |
| 5,984,518 | | 11/1999 | King et al. . |
| 5,988,979 | | 11/1999 | Wang . |
| 6,062,721 | | 5/2000 | King et al. . |
| 6,068,395 | | 5/2000 | Ondracek . |
| 6,193,405 | | 2/2001 | King et al. . |
| 6,257,753 | * | 7/2001 | King et al. ..... 366/605 |

* cited by examiner

MIXING DEVICE WITH VANES HAVING SLOPING EDGES AND METHOD OF MIXING VISCOUS FLUIDS

PRIOR APPLICATION DATA

This application is a continuation of U.S. application Ser. No. 09/505,225 filed Feb. 16, 2000, now U.S. Pat. No. 6,286,989, which is a continuation-in-part of U.S. application Ser. No. 09/091,145 filed Apr. 16, 1999, now U.S. Pat. No. 6,062,721, which is a 371 of International Application No. PCT/US96/19345, filed Dec. 5, 1996, which is a continuation of U.S. application Ser. No. 08/567,271, filed Dec. 5, 1995, now abandoned.

FIELD OF THE INVENTION

The present invention relates to a method and apparatus for mixing fluids.

BACKGROUND OF THE INVENTION

The mixing of viscous fluids has historically been a difficult task. Present methods of mixing such fluids often result in inadequate mixing and are time-consuming and energy consumptive.

One of the more common viscous fluids which must be mixed is paint. Homeowners and painters are all too familiar with the task of mixing paint.

Probably the most common method of mixing fluid such as paint involves the user opening the container, inserting a stir stick or rod and rotating or moving the stick about the container. This method is tiring, requiring tremendous effort to move the stir stick through the viscous fluid. Because of this, individuals often give up and stop mixing long before the paint is adequately mixed. Further, even if the individual moves the stir stick for a long period of time, there is no guarantee that the paint is thoroughly mixed, rather than simply moved about the container.

Many mechanisms have been proposed for mixing these fluids and reducing the manual labor associated with the same. These mechanisms have all suffered from at least one of several drawbacks: users have difficulty in using the device because of its complexity or size, the device inadequately mixes the fluid, the device mixes too slowly, the device does not break up or "disperse" clumped semi-solids in the fluid, and/or the users have a difficult time cleaning up the device after using it. Other problems associated with these mixers are that they often introduce air into the fluid (which, in the case of paint and other coating materials is detrimental, for example, when the material is to be sprayed with a sprayer), they do not trap globules/particles which do not go into solution, and many of the mixing devices may damage the container in which the fluid is being mixed, causing the fluid to leak from the container or parts of the damaged container to enter the material being mixed.

One example of such a mechanized mixing device is essentially a "screw" or auger type device. An example of such a device is illustrated in U.S. Pat. No. 4,538,922 to Johnson. This device is not particularly effective in mixing such fluids, as it imparts little velocity to the fluid. Further, the device does not disperse clumped material in the fluid, but simply pushes it around the container.

Another method for mixing paint comprises shaking the paint in a closed container. This can be done by hand, or by expensive motor-driven shakers. In either instance, the mixing is time consuming and often not complete. Because the shaking occurs with the container closed, little air space is available within the container for the fluid therein to move about. Therefore, the shaking often tends to move the fluid very little within the container, with the result being ineffective mixing.

Several devices have been developed for mixing paint which comprise devices for connection to drills. For example, U.S. Pat. No. 4,893,941 to Wayte discloses a mixing device which comprises a circular disc having vanes connected thereto. The apparatus is rotated by connecting a drill to a shaft which is connected to the disc. This device suffers from drawbacks. First, the limited number of vanes does not provide for thorough mixing. Second, because the bottom disc is contiguous, no fluid is drawn through the device from the bottom. It is often critical that fluid from the bottom of the container be drawn upwardly when mixing viscous fluids, since this is where the heaviest of the fluids separate prior to mixing.

U.S. Pat. No. 3,733,645 to Seiler discloses a paint mixing and roller mounting apparatus comprising a star-shaped attachment. This apparatus is not effective in mixing paint, as it does not draw the fluid from the top and bottom of the container. Instead, the paddle-like construction of the device simply causes the fluid to be circulated around the device.

U.S. Pat. No. 1,765,386 to Wait discloses yet another device for mixing liquids. This device is wholly unacceptable, as it must be used in conjunction with a diverter plate located in the container to achieve adequate mixing. Use of the diverter plate would either require its installation into a paint container before being filled, which would increase the cost of paint to the consumer, or require that the consumer somehow install the device into a full paint container.

An inexpensive method for mixing viscous fluids in a quick and effective manner is needed.

SUMMARY OF THE INVENTION

The present invention is a method and apparatus for mixing viscous fluids.

One embodiment of the invention comprises a mixing device including a mixing cage connected to a shaft. The shaft is elongate, having a first end connected to a central plate and a second free end for connection to the rotary drive means. The plate is solid, circular, and has a top side, bottom side, and outer edge. Vanes in the form of thin, curved slats, are spacedly positioned about the outer edge of each side of the plate. The vanes extend outwardly from each side of the plate parallel to the shaft. In one or more embodiments, a first end of each vane is connected to the plate near the outer edge thereof. In various embodiments, the vanes are connected at their second ends by a hoop, the vanes have a length which is between about 0.1–2 times the diameter of the plate, the number of vanes located about each side of the plate preferably number between 4 and 12 per inch diameter of the plate, and/or each vane extends inwardly from the periphery of the plate no more than about 0.1–0.35 of the distance from the center of the plate to the periphery thereof at that location.

In another embodiment of the invention, the mixing device has a central support with vanes extending outwardly from one or both sides thereof generally parallel to an axis extending through the support perpendicular to the sides thereof. Each vane has a first end connected to the support and a second end positioned remote from the support, the vanes extending from at least one of the sides of the support generally parallel to the axis, each vane having an outer edge and an inner edge, the outer edge positioned near the periphery of the support, each vane extending inwardly towards the center of the support and extending inwardly a greater distance at the first end than the second end.

One or more embodiments of the invention comprise a method of mixing comprising locating a mixing device in a container of fluid and rotating the device in the fluid. In one embodiment, the method includes the steps of a user positioning the mixing cage of the device in a container of fluid, connecting a free end of a shaft of the device to the rotary drive means, such as a drill, and rotating the mixing cage within the fluid.

Further objections, features, and advantages of the present invention over the prior art will become apparent from the detailed description of the drawings which follows, when considered with the attached figures.

DETAILED DESCRIPTION OF THE INVENTION

The invention is a method and apparatus for mixing viscous fluids. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Generally, the invention comprises a mixing device and a method of mixing fluid in a container containing a fluid to be mixed with the device. As used herein, the term "fluid" generally means liquids, especially those of a viscous nature whether containing dissolved or undissolved solids, slurries, gels and those groupings of solid or semi-solid materials which behave in some respects as a fluid, such as granular materials (e.g. flour, sugar, sand etc.).

Figure 1:
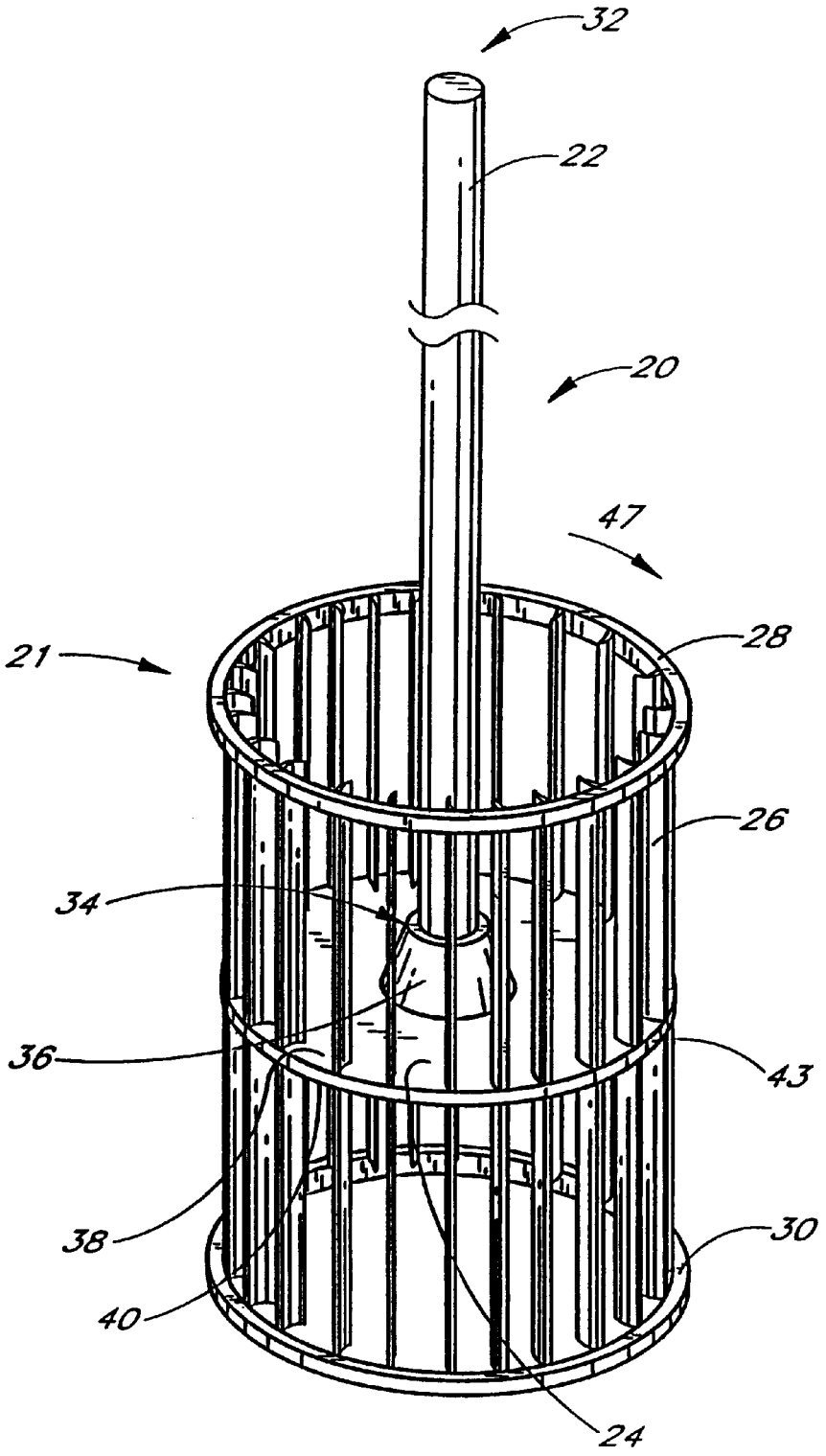
FIG. 1 is a perspective view of a mixing device in accordance with a first embodiment of the invention for use in the method of the present invention.
Figure 5:
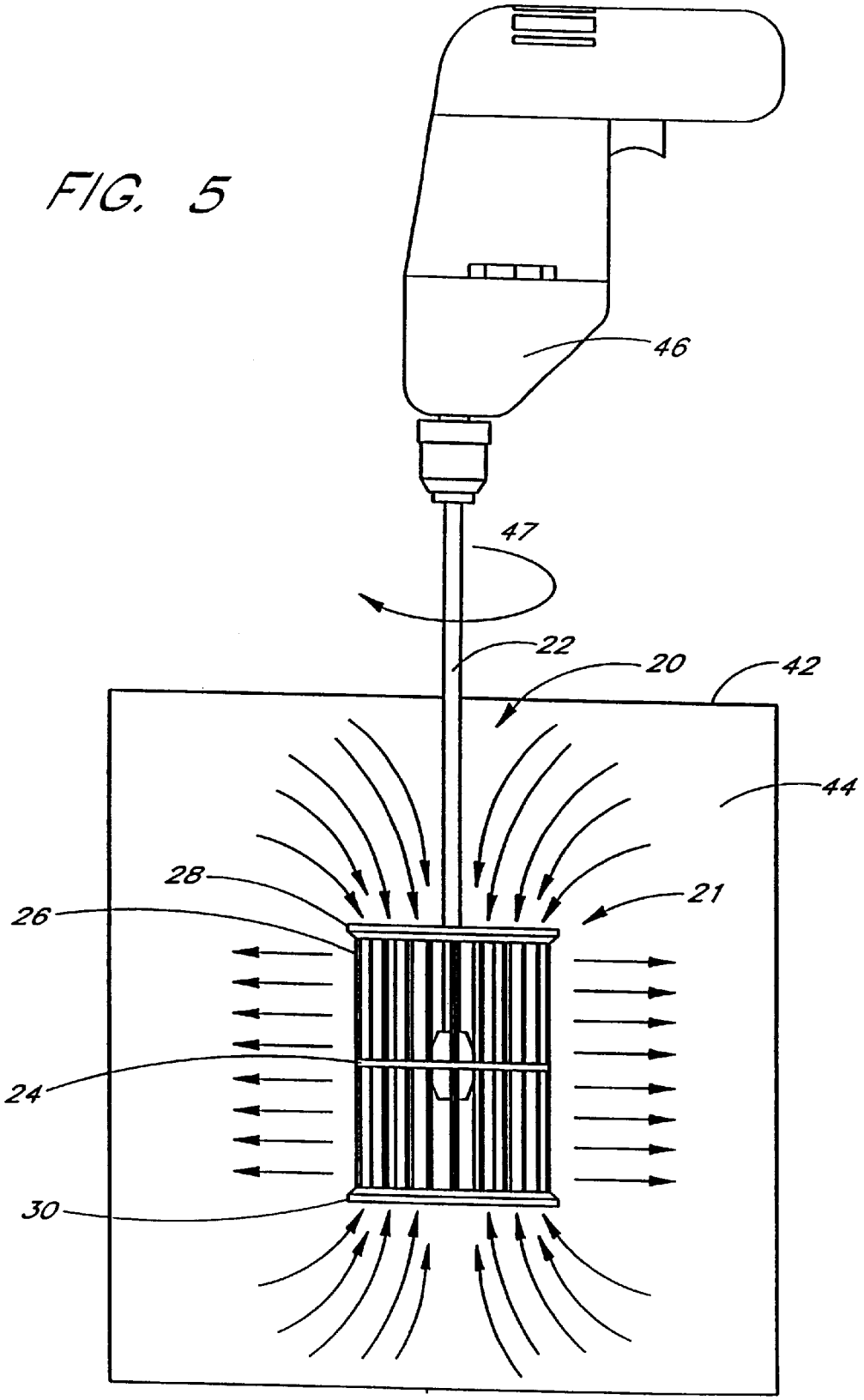
FIG. 5 illustrates use of the mixing device illustrated in FIG. 1 to mix a fluid in a container.

One embodiment of a mixing device 20 in accordance with the present invention is illustrated in FIG. 1 This embodiment mixing device 20 generally comprises a cage-like structure having open ends. As illustrated in FIG. 5, the device 20 includes a shaft 22 for rotation by rotary drive means such as a drill 46, the shaft connected to a central connecting plate 24. Vanes 26 extend outwardly from each side of the central connecting plate 24 parallel to the shaft 22. The vanes 26 are connected at their ends opposite the plate by a hoop 28,30.

In use, a user positions the mixing device in a container 42 of fluid 44. The user connects the shaft 22 of the device 20 to a drill 46 and rotates it within the fluid. As illustrated in FIG. 5, the mixing device 20 mixes the fluid by drawing it from the top and bottom of the container 42 and forcing it radially outward through the vanes 26.

The mixing device 20 for use in the present invention will now be described with more particularity with reference to FIG. 1–5. In general, and as illustrated in FIG. 1, the device 20 includes mixing cage 21 connected to a shaft 22, the mixing cage 21 comprising a central connecting plate 24, vanes 26, and two hoops 28, 30.

The shaft 22 is an elongate rigid member having a first end 32 and second end 34. The exact length and diameter of the shaft 22 depends on the depth of the fluid in the container to be mixed. When the device 20 is for use in mixing paint in a standard one-gallon paint can, the shaft 22 can be about 8–9 inches long and about 0.25 inches in diameter.

The first end 32 of the shaft 22 is adapted for connection to a rotary drive means. Preferably, the rotary drive means comprises a drill, as illustrated in FIG. 5. Preferably, the shaft diameter is chosen so that engagement with the rotary drive means is facilitated.

The second end 34 of the shaft 22 is connected to said central plate 24. Preferably, the second end 34 of the shaft 22 engages an adapter 36 connected to the plate 24. The shaft end 34 engages the plate 24 at the center point of the plate 24.

The central plate 24 comprises a flat, disc-shaped member having a top surface 38, bottom surface 40 and outer edge 43. The shaft 22 engages the plate 24 at the top surface 38 thereof.

Preferably, the plate 24 is constructed of durable and fairly rigid material. The plate 24 may be any of a variety of sizes. When used to batch mix a one gallon quantity of highly viscous (i.e. resists flow) liquids such as paint, it is preferably about 1–4, and most preferably about 2.5 inches in diameter.

A number of vanes 26 extend from the top and bottom surface 38, 40 respectively, of the plate 24 near the outer edge 43 or periphery thereof. Each vane 26 has a concave surface 27 and a convex surface 29 (see FIG. 2 and 4). All of the vanes 26 are oriented on the plate 24 in the same direction. The vanes 26 are oriented on the plate 24 in a manner such that they face in the direction of rotation indicated by arrow 47 in FIGS. 1,2,4 and 5, when rotated by the rotational drive means 46.

The vanes 26 are preferably constructed of durable and fairly rigid material. It has been found preferable that the ratio of the length of the vanes 26 to the diameter of the plate be between about 0.1 and 2, and most preferably between 0.2 and 0.7. Moreover, it has been found preferable that the number of vanes 26 be dependent on the ratio of the diameter of the plate 24 on the order of about 4–12, and most preferably about 9 vanes per inch diameter of the plate 24. The width of each vane 26 is preferably no more than 0.1 to 0.35 times the radius of the plate, 24 and more preferably about 0.1–0.3, and most preferably about 0.25 times the radius of the plate 24. The thickness of each vane 26 depends on the material from which it is made. Regardless of its width, each vane 26 is preferably positioned at the outer edge 43 of the plate 24 such that the vane 26 extends inwardly therefrom no more than about 0.1–0.35, more preferably less than about 0.3, and most preferably less than about 0.25, of the distance from the center of the plate 24 to the periphery thereof at that vane 26 location (i.e. less than about 0.35 the radius when the plate 24 is circular).

When the device 20 is configured for use in mixing paint in a one-gallon container and the plate 24 diameter is about 2.5 inches, the vanes 26 are preferably about 1 inch long from their ends at the connection to the plate 24 to their ends connected at the hoops 28, 30. Each vane 26 is preferably about 0.2–1, and most preferably about 0.3 inches wide.

Figure 2:
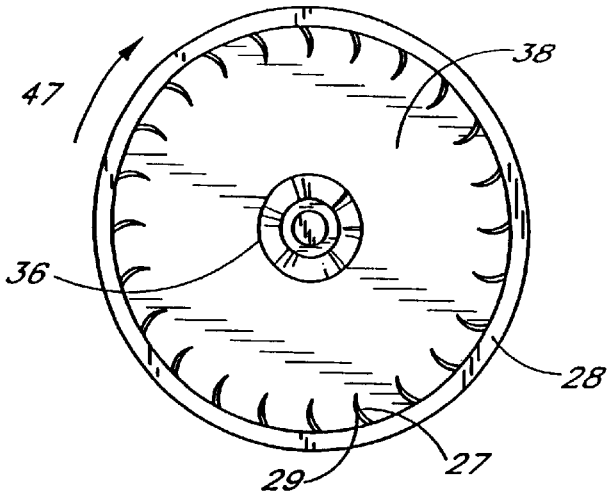
FIG. 2 is a top view of the mixing device illustrated in FIG. 1.
Figure 4:
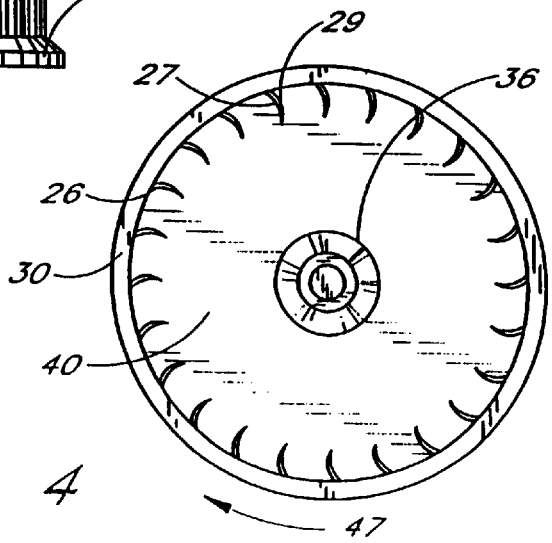
FIG. 4 is a bottom view of the mixing device illustrated FIG. 1.

In order to disperse partially solidified particulate in the fluid, the vanes 26 are fairly closely spaced about the outer edge 43 of the plate 24. The vanes 26 are preferably spaced about 0.1–1 inch, and most preferably about 0.25 inches apart. When the vanes 27 are spaced far apart (e.g. about 1 inch) the vane width and/or height is preferably increased within the above-stated range or ratios. Thus, in the case where the plate 24 has a diameter of about 2.5 inches, there are preferably about twenty-four vanes 26, as illustrated in FIGS. 1, 2 and 4.

Figure 3:
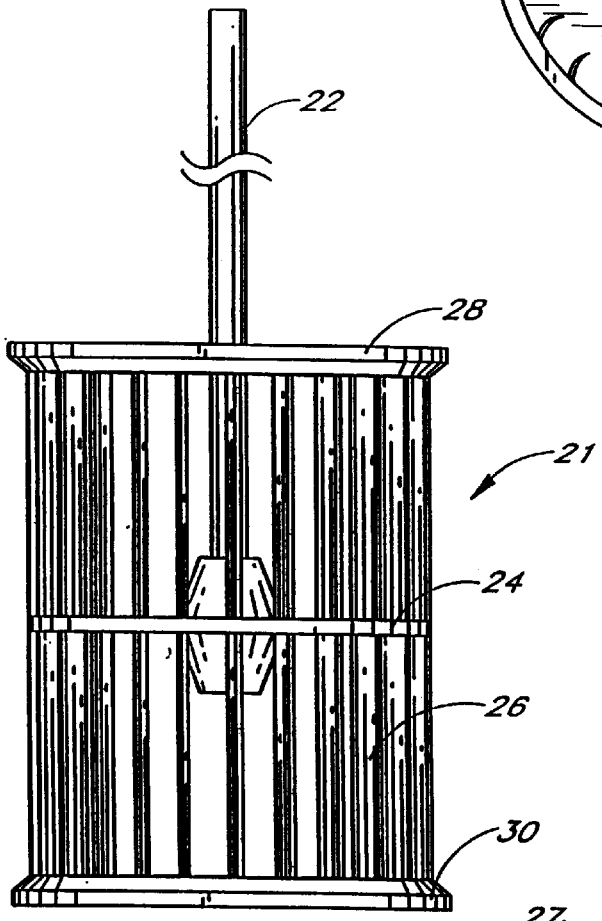
FIG. 3 is a side view of the mixing device illustrated in FIG. 1.

In order to prevent relative movement between the free ends of the vane 26, the free end of each vane is connected to a support hoop 28,30. Each hoop 28,30 comprises a relatively rigid circular member. A first portion of each hoop 28,30 extends over the end of each of the vanes, and a second portion of each hoop 28,30 extends downwardly along the outer surface of each vane, as illustrated in FIGS. 2–4. In other embodiments, the hoops 28,30 may be configured and connected in other manners. Each vane 26 is securely connected to its corresponding hoop 28,30.

Use of the device 20 described above in the method of the resent invention will now be described with reference to FIG. 5.

A user obtains a container 42 containing fluid 44 to be mixed. This container 42 may comprise a paint can or any other container. The fluid 44 to be mixed may comprise nearly any type of fluid, but the method of the present invention is particularly useful in mixing viscous fluids.

The user attaches the device 20 of the present invention to rotary drive means. As illustrated in FIG. 5, the preferred means comprises a drill 46. The means may comprise apparatus other than a drill, however, such as hand-driven, pulley or gas motor driven means. These drive means preferably turn the shaft 22 of the device at speed dependent upon the viscosity of the fluid. For example, for low viscosity fluids, the rotational speed may be often as low as about 500 rpm, while for high viscosity fluids the rotational speed may often be as high as 1,500 rpm or more.

The user attaches the first end 32 of the shaft 22 to the drill 46, such as by locating the end 32 of the shaft in the chuck of the drill. Once connected, the user lowers the mixing cage 21 into the fluid 44 in the container 42. The user locates the mixing cage 21 below the top surface of the fluid.

Once inserted into the fluid 44, the drill 46 is turned on, thus effectuating rotational movement of the mixing cage 21. While the cage 21 is turning, the user may raise and lower it with respect to the top surface of the fluid and the bottom of the container, as well as move it from the center to about the outer edges of the container, so as to accelerate the mixing of the fluid therein.

Advantageously, and as illustrated in FIG. 5, the device 20 of the present invention efficiently moves and mixes all of the fluid 44 in the container 42. In particular, because of the location of vanes extending from and separated by the central plate 24, the mixing cage 21 has the effect of drawing fluid downwardly from above the location of the cage 21, and upwardly from below the cage, and then discharging the fluid radially outwardly (as illustrated by the arrows in FIG. 5). This mixing effect is accomplished without the need for a diverter plate in the bottom of the container.

Most importantly, partially solid particulate in the fluid is effectively strained or dispersed by the vanes 26 of the cage 21. The close spacing of the vanes 26 traps unacceptably large undeformable globules of fluid or other solid or partially solid material in the cage, for removal from the cage after mixing. Other globules of partially solidified fluid material are sheared apart and dispersed when they hit the vanes, reducing their size and integrating them with the remaining fluid.

Advantageously, optimum mixing is achieved with the present device 20 as a result of the positioning of substantially long inner and outer vane edges away from the center of the device and thus at the periphery of the plate 24. This allows the fluid moving though the device 20 to impact upon the inner edge of the vane 26 at a high radial velocity and therefore with great force. Further, the outer edge of the vane has a high velocity in relation to the fluid in the container positioned outside of the device 20, thereby impacting upon that fluid with great force.

The ratio of the length of each vane to its width, and the placement of the vanes at the periphery of the plate, creates maximum fluid flow through the cage 21. This is important, for it reduces the total time necessary to thoroughly mix the fluid in a particular session.

Notably, the hoops, 28,30 protect the container from damage by the spinning vanes 26. This allows the user to be less careful in positioning the cage 21 in the container 42, as even if the cage 21 encounters the sides or bottom of the container, the cage is unlikely to damage the container.

Another advantage of the mixing device 20 of the present invention is that it mixes the fluid without introducing air into the fluid, as is a common problem associated with other mixers utilized for the same purpose. As can be understood, the introduction of air into a fluid such as paint is extremely detrimental. For example, air within paint will prevent proper operation of many types of paint sprayers and makes uniform coverage when painting difficult. The presence of air is also detrimental, for example, where a polyurethane coating is being applied, as air bubbles become trapped in the coating and ruin its appearance.

After the fluid has been adequately mixed, cleaning of the device 20 is fast and easy. A user prepares a container filled with a cleaning agent. For example, in the case of latex paints, water is an effective cleaning agent. The user lowers the cage 21 into the cleaning agent, and turns on the drill 46. The rapid movement of the cleaning agent through the cage 21 causes any remaining original fluid (such as paint) or trapped globules thereon to be cleansed from the device 20.

Once the device 20 is clean, which normally only takes seconds, the device can be left to air dry.

The dimensions of the device 20 described above are preferred when the device is used to mix fluid in a container designed to hold approximately 1 gallon of fluid. When the device 20 is used to mix smaller or larger quantities of fluid of similar viscosity, the device 20 is preferably dimensionally smaller or larger.

While the vanes 26 used in the device 20 are preferably curved, it is possible to use vanes which are flat. The vanes 26 are preferably curved for at least one reason, in that such allows the vanes 26 to have an increased surface area without extending inwardly from the periphery towards the center of the plate 24 beyond the preferred ratio set forth above. Also, it is noted that while the vanes 26 extending from the top and bottom of the plate 24 are preferably oriented in the same direction, they may be oriented in opposite directions (i.e. the convex surfaces of the top and bottom sets of vanes 26 may face opposite directions).

In an alternate version of the invention, vanes only extend from one side of the plate. The vanes may extend from either the top or the bottom side. Such an arrangement is useful when mixing in shallow containers, while retaining the advantages of high fluid flow mixing rates and the straining capability.

A mixing device 120 and method of use in accordance with a second embodiment of the present invention will be described with reference to FIGS. 6–10. This embodiment mixing device 120 is particular suited to applications in which the diameter or other maximum radial/outward dimension of the device 120 is limited.

Figure 6:
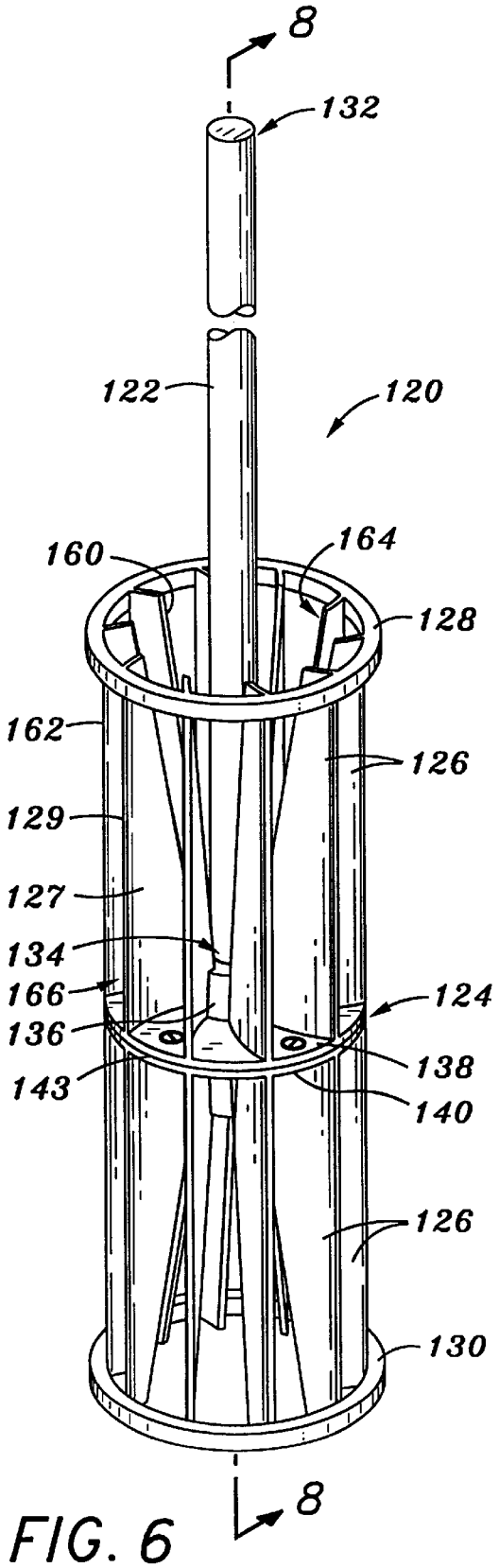
FIG. 6 is a perspective view of a mixing device in accordance with another embodiment of the invention.

Referring first to FIG. 6, the mixing device 120 is similar in many respects to the device 20 illustrated in FIGS. 1–5, except for the configuration of vanes thereof. Thus, the mixing device 120 comprises a cage-like structure having generally open ends. The device 120 includes a shaft 122 for rotation by a rotary drive means such as a drill (in similar fashion to that illustrated in FIG. 5). The shaft 122 connects to a central connecting plate or support 124.

As in the prior embodiment, the shaft 122 may be constructed from a variety of materials and be of a variety of sizes. The shaft 122 has a first end 132 for connection to a rotary drive device and a second end 134 connected to the central plate 124. As illustrated, the second end 134 of the shaft 122 engages a hub 136 or similar adaptor member associated with the central plate 124. The second end 134 of the shaft 122 securely engages the central plate 124 and aids in preventing relative rotation of the shaft 122 with respect to the central plate 124.

In one or more embodiments, the central plate 124 has an outer edge 143 defining a generally circular perimeter. Preferably, the shaft 122 is connected to the plate 124 at a center thereof, whereby the mixing cage rotates generally symmetrically about an axis through the shaft 122. As described in more detail below, the configuration of this mixing device 120 is particularly suited to use in environments where access to the material to be mixed is limited, such as through a small opening in a container. As such, in one or more embodiments, the central plate 124 has a diameter of about 1–3 inches. While the mixing device 120 may have a larger overall size, in general, the performance of the device will be somewhat less than a mixing device 20 such as described above.

A number of vanes 126 extend from one or both of a top side 138 and bottom side 140 of the central plate 124. As illustrated, vanes 126 extend from both the top and bottom side 138,140 of the plate 124. Each vane 126 has an inner edge 160 and an outer edge 162. Preferably, the outer edge 162 of each vane 126 is located near the outer periphery of the central plate 124 and extends generally along a line perpendicular to the plate 124.

Figure 10:
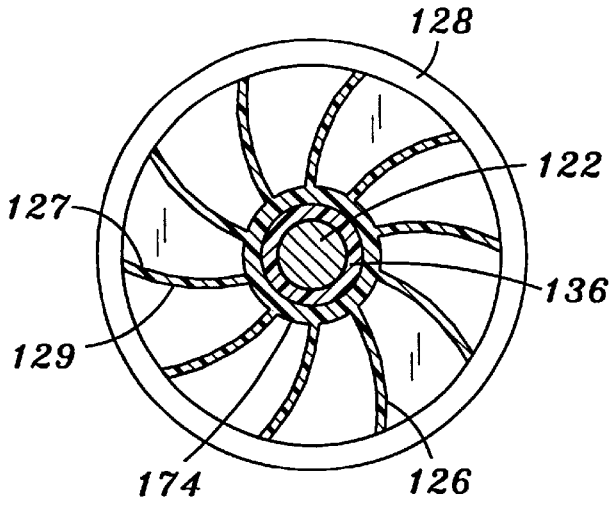
FIG. 10 is a cross-sectional view of the mixing device illustrated in FIG. 8 taken along line 10—10 therein.
Figure 9:
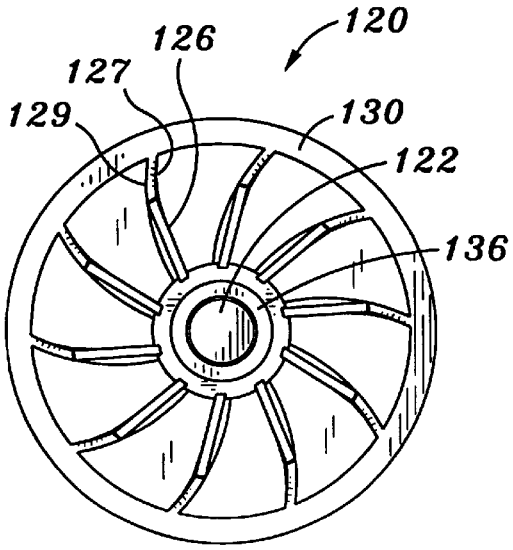
FIG. 9 is an end view of the mixing device illustrated in FIG. 8 taken in the direction of line 9—9 therein.

Referring to FIGS. 9 and 10, in one or more embodiments, each vane 126 is curved between its inner edge 160 and outer edge 162. The curved shaped of each vane 126 causes it to have a concave surface 127 and a convex surface 129. Preferably, all of the vanes 126 on each side of the central plate 124 are oriented in the same direction. When vanes 126 are positioned on both sides of the central plate 124, the vanes 126 on opposing sides may be oriented in different directions.

Figure 8:
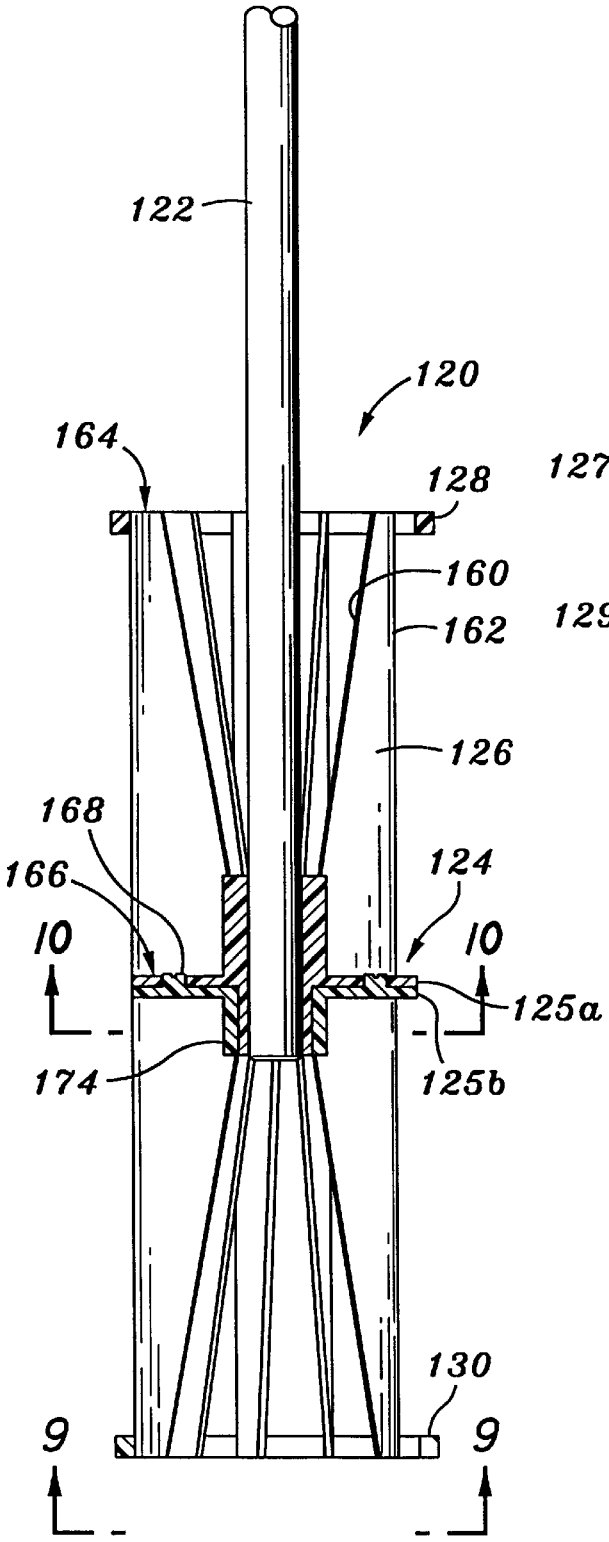
FIG. 8 is a cross-sectional view of the mixing device illustrated in FIG. 6 taken along line 8—8 therein.

Referring to FIGS. 6 and 8, each vane 126 has a first, top or distal end 164 and a second, bottom or proximal end 166. Preferably, each bottom or proximal end 166 is connected to the central plate 124. The top or distal end 164 is positioned remote from the central plate 124. In one or more embodiments, a connector connects the top ends 164 of the vanes 126. As illustrated in FIG. 9, the top ends 164 of the vanes 126 define a first opening therebetween and the bottom ends 166 of the vanes 126 define a second opening therebetween. As illustrated, the first opening is larger than the second opening. In the embodiment illustrated, a first hoop 128 connects the top ends 164 of the vanes 126 extending from the top side 138 of the central plate 124. A second hoop 130 connects the top ends 164 of the vanes 126 extending from the bottom side 140 of the plate 124.

As illustrated, each hoop 128,130 is generally circular. Preferably, each hoop 128,130 extends outwardly beyond the outer edges 162 of the vanes 126. In this configuration, the hoops 128,130 present smooth, contiguous surfaces which protect the vanes 126 and container, such as when the mixing device 120 is brought into contact with a container. In such event, the vanes 126 do not catch or hit the container, protecting them and the container. In addition, the smooth nature of the hoops 128,130 is such that if they contact a container, they are likely to bounce off of the container and do not damage it and are not themselves damaged.

In one or more embodiments, each vane 126 has a length dependent upon the diameter of the central plate 124 (when the vanes are positioned at the periphery of the plate). In a preferred embodiment, a length of each vane 126 in inches to the diameter of the plate in inches falls within the ratio of about 0.1–2, and more preferably about 1–2, and most preferably about 1.6. As described in detail below, when the diameter of the central plate 124 is fairly small and the vanes 126 are spaced closely together, it is generally desirable for the vanes to be relatively long. When the vanes 126 are long, the material contact surface area for mixing is maximized. In addition, the vanes 126 then define elongate flow openings which permit a high flow rate, and thus fast mixing. At the same time, because the vanes 126 are still closely spaced, they still trap globules.

Each vane 126 preferably extends inwardly from the outer periphery 143 of the central plate 124. In a preferred embodiment, the bottom end 166 of each vane 126 extends inwardly towards the center of the central plate 124 by a distance which is greater than a distance the vane extends inwardly at its top end 164. In one or more embodiments, the vanes 126 extend inwardly at their top ends 164 about 0.2–0.4, and more preferably about 0.3, inches per inch radius of the plate 124. The vanes 126 extend inwardly at their bottom ends 166 about 0.5–0.7, and more preferably about 0.6, inches per inch radius of the plate 124. As will be appreciated, the maximum distance the vanes 126 may extend inwardly is limited to some degree by the size of the shaft 122 which extends through the top portion of the mixing cage and the associated hub.

It has been found preferable for the number of vanes 126 to be dependent upon a spacing there between. As disclosed below, and in similar fashion to the mixing device 20 described above, it is desirable to maintain the vanes fairly closely spaced so that they are effective in trapping globules and other material which will not go into solution. Preferably, the spacing between the outer edges 162 of the vanes 126 at their top ends 164 is about 0.3–0.7, and most preferably about 0.5 inches. The spacing between the inner edges 160 of the vanes 126 at their bottom ends 166 is preferably about 0.1–0.3, and most preferably about 0.2–0.25 inches. Preferably, the spacing between the inner edges 160 of the vanes 126 at their top ends 164 is about 0.1–0.7, and most preferably about 0.3–0.4 inches. The spacing between the inner edges 160 of the vanes 126 at their bottom ends 166 is preferably about 0.1–0.3, and most preferably about 0.2–0.25 inches.

It will be appreciated that the spacing between the vanes 126 in the present embodiment is closest at their bottom ends 166 due to the curved configuration of the vanes 126 and because they extend inwardly towards the center of the plate the greatest distance at their bottom ends. As described in detail below, the spacing between the vanes 126 at their top ends may be larger than the spacing which is generally desirable for trapping large globules. This is because the globules which do not go into solution and are smaller than the spacing between the vanes 126 at their top ends 164 will still be trapped near the bottom ends 166 of the vanes because of their narrower spacing. At the same time, however, the increased spacing between the vanes 126 at their top ends 164 is a result of maintaining the inner edges 160 of the vanes 126 at their top ends 164 nearest the outer perimeter of the plate 124, which promotes a high fluid velocity as it is contacted by the rapidly spinning vanes thereby maximizing shear effect.

It will be appreciated that the total number of vanes 126 may vary dependent upon their thickness, even though the spacing there between remains the same. Preferably, the number of vanes 126 totals about 4–8, and more preferably about 6 vanes per inch of diameter plate. At the same time, the vanes 126 are preferably configured to maintain the desired spacing there between.

In a preferred embodiment where vanes 126 extend from both sides of the central plate 124, the central connecting plate 124 comprises a top portion 125*a* and a bottom portion 125*b* which may be selectively connected and disconnected. FIG. 6 illustrates the top and bottom portions 125*a*,125*b* in their connected position, while FIG. 7 illustrates them in their disconnected position.

Figure 7:
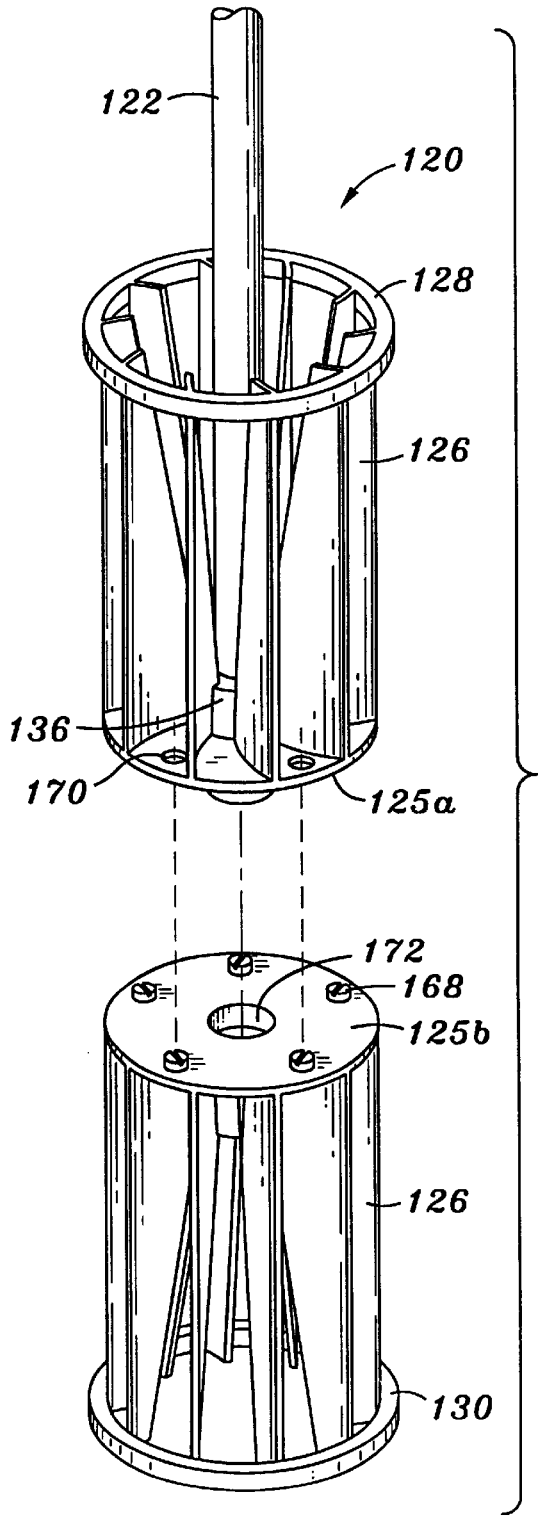
FIG. 7 is a perspective view of the mixing device illustrated in FIG. 6 in a separated state.

Referring to FIGS. 7 and 8, one set of vanes 126 extends outwardly from a top side of the top portion 125*a* of the central plate 124. Another set of vanes 126 extends outwardly from a bottom side of the bottom portion 125*b* of the central plate 124.

Means are provided for selectively connecting the top and bottom portions 125*a*,125*b* of the plate 124. In one embodiment, this means comprises one or more pins 168 extending from a top side of the bottom portion 125*b* of the central plate 124. These pins 168 are adapted to engage bores 170 provided in the top portion 125*a* of the central plate 124. In one or more embodiments, the pins 168 are slotted. This permits the pins 168 to be compressed when inserted into a mating bore 170. Once inserted, the biasing force generated as a result of the pin 168 being inserted into the bore 170 serves to retain the pin 168 securely with the top portion 125*a* of the plate 124.

In addition, the hub 136 extends from the bottom surface of the top portion 125*a* of the central plate 124. A mating port or bore 172 is provided in the bottom portion 125*b* of the central plate 124 for accepting the hub extension. The mating of the hub extension and port 172 aids in aligning the two portions of the mixing device 120. As illustrated in FIG. 8, in one or more embodiments, a hub 174 extends downwardly from the bottom side of the bottom portion 125*b* of the plate 124. The hub 174 is sized to accept the hub extension. The locations of the pins 168 around the port 172 serves to prevent rotation of the bottom portion of the mixing device relative to the top portion when the mixing device 120 is in use.

As will be appreciated, the size (namely, the length) of the mixing device 120 is reduced when the bottom portion 125*b* of the central plate 124 is disconnected from the top portion 125*a* of the plate. This is advantageous when fluid to be mixed is contained in a shallow container. It will be appreciated that the embodiment device 20 described above may be similarly configured to be "divisible" into two portions for use in shallow containers as well.

Use of the mixing device 120 of this embodiment of the invention is similar to that of the mixing device 20 described above and illustrated in FIG. 5. In particular, a rotary drive is coupled to the shaft 122 and the device 120 is located in a container containing material to be mixed. The device 120 is then rotated to mix the material.

Preferably, the device 120 is rotated so that the convex surfaces of the vanes 126 face in the direction of rotation. As in the prior embodiment, it is possible for the vanes 126 to be flat or be concave in the direction of rotation, though it has been found that such often results in undesirable turbulence during mixing as compared to the preferred arrangement.

As with the prior embodiment, mixing with this device 120 is extremely effective. First, mixing is generally accomplished in one or more magnitudes less time than in the prior art. Further, the mixing is uniform and very thorough, with globules of material strained by the device 120 for removal from the material.

The mixing device 120 illustrated in FIGS. 6–10 and described above has particular applicability in situations where the radial dimension of the mixing device 120 from the shaft 122 is limited. For example, a five gallon container of paint may be provided with an access opening having a diameter of only approximately two inches. In such event, the maximum radial dimension of the mixing device 120 is limited to less than one inch. In the illustrated embodiment, this means that the hoops 128,130 (which extend outwardly the farthest from the shaft 122) must not extend outwardly from a centerline of the device 120 by more than one inch.

It has been found that the mixing device 120 exhibits characteristics similar to those of the mixing device 20 described above. The location of a substantial portion of each vane 126 near the outer edge 143 of the plate 124 causes material flowing through the device 120 to impact on the vanes 126 with a high velocity. The material being mixed flows into the device 120 and is then directed outwardly, gaining a high radial velocity. Now moving at high speed, the material then hits the vanes 126 with high force. In addition, since a substantial portion of each vane 126 is positioned near the outer edge 143 of the plate 124, the outer portion of each vane 126 has a high angular velocity with respect to the material which is passing there through, facilitating shearing of the material.

It will be appreciated that the vanes 126 need not be located at the outer edge of the plate 124 so long as the vanes 126 meet the above-described criteria and are located sufficiently far enough from the center of the plate to achieve the desired shearing effect. For example, it is contemplated that the plate 124 may comprise a large disc (or multiple discs) with the outer edge of each vane positioned some distance inwardly from the outer edge of the disc. Such a configuration has the advantage that when the plate 124 extends beyond the outer edges of the vanes 126, the plate 124 may protect the container and the vanes 126 in a similar manner as the hoops 128,130. Those of skill in the art will appreciate that the vanes 126 are still preferably configured as described above to achieve the effects described herein, though in such case the above references of vane dimensions and configurations to the total size of the plate and the position at the "outer edge" of the plate 126 must be reconstrued to accommodate for the extension of the plate beyond the vanes. Preferably, the ratio of the length of the vanes extending from one side of the plate 124 to their distance from the center of the plate 124 is about 0.1–3 (i.e. if each vane is about 2 inches long, then their distance from the center of the plate 124 to their outer edges may be 0.2–6 inches, and the plate 124 may extend beyond the outer edges of the plate 124).

On the other hand, the configuration of the vanes 126 provides for maximum flow through the device 120, when considering the limitation of its overall radial size. In particular, the vanes 126 increase in width from their top 164 to their bottom ends 166. This facilitates a larger vane surface area than if the vanes 126 were of the same width along their length beginning with the width of their top end 164. Yet, to facilitate the above-described functions, the outer edge of each vane 126 is still located at the outer edge 143 of the plate 124, and a substantial portion of the inner edge 160 of each vane 126 is positioned a substantial distance radially outward from the center of the device 120.

Having the top ends 164 of each vane 126 be narrow in width also provides for a large open end at each end of the device 120 through which material may be drawn. In addition, the number of vanes 126 is selected so that their spacing serves to trap globules of material, and along with the length of the vanes 126 serves to increase the contact surface area for mixing the material. Because of the close spacing of the vanes 126 (especially at their bottom ends 166), most all undesirable globules and other material which will not go into solution can be strained from the material being mixed.

Because the vanes 126 are relatively long, the flow area between the vanes is increased even though the spacing between them is minimal. This means that globules are still trapped while permitting a substantial flow of material through the device 120, thus mixing the material quickly.

The length of the vanes 126 in relation to the diameter of the plate 124 may be adjusted dependent upon a wide variety of factors. In particular, if the vanes 126 become too long, especially when considering the viscosity of the material being mixed and the radius of the inlet(s) being restricted to minimal size, the flow through the device may be somewhat inhibited. In such an event, the length of the vanes may be found to be an inhibiting factor on mixing performance.

It will also be appreciated that the number of vanes 126 and their length may vary dependent to some degree on the particular application and the speed at which the mixing device 120 is to be operated. As detailed above, it may be preferable for the vanes 126 to be shorter in relation to the diameter of the plate 124 and may be positioned closer to the center of the plate 124 when the material to be mixed is extremely viscous. Also, the vanes 126 may be shorter when the speed of rotation is very high, as the higher rotational speed aids in the mixing/shearing action without the need for such long vanes.

As with the prior mixing device 20, when the mixing device 120 of this embodiment of the invention is used, air is not introduced into the material being mixed, so long as the device 120 is properly positioned below the surface of the material being mixed.

It will be understood that the above described arrangements of apparatus and the method therefrom are merely illustrative of applications of the principles of this invention and any other embodiments and modifications may be made without departing from the spirit and scope of the invention as defined in the claims.

I claim:

1. A method of mixing fluid comprising:

isolating a fluid to be mixed in a container;

providing a mixing device comprising a shaft extending along an axis, a support mounted for rotation by said shaft, a number of vanes having a first end and a second end, said vanes having an outer edge and an inner edge, said vanes positioned radially outward from said axis and mounted for rotation with said support, said first ends of said vanes defining a first opening therebetween and said second ends defining a second opening therebetween, said first opening being larger than said second opening, at least a portion of said inner edge of one or more of said vanes extending inwardly toward said axis no more than about 0.3 of the distance between the outer edge of said vane and said axis;

positioning said device in said container containing fluid to be mixed;

rotating said mixing device within said fluid in said container;

drawing fluid into at least one of said first or second openings defined by said vanes;

expelling said fluid through said vanes; and shearing fluid as it passes through said vanes, shearing and dispersing particulate material within said fluid, thereby homogenizing said fluid.

2. The method in accordance with claim 1 wherein said support comprises a generally circular plate.

3. The method in accordance with claim 1 wherein said inner edge of one or more of said vanes slope toward said axis moving in a direction from said first end to said second end of said vane.

4. A method of mixing fluid comprising:

isolating a fluid to be mixed in a container;

providing a mixing device comprising a shaft extending along an axis, a support mounted for rotation by said shaft, a number of vanes mounted for rotation with said support, said vanes having a first end and a second end, said vanes having an outer edge and an inner edge, said inner edge of one or more of said vanes positioned closer to said axis at said first end than at said second end thereof, at least a portion of said inner edge of one or more of said vanes extending inwardly toward said axis no more than about 0.3 of the distance between the outer edge of said vane and said axis, said device having at least one generally open end into which fluid may be drawn into an interior space defined at least in part by said vanes;

positioning said device in said container containing fluid to be mixed;

rotating said mixing device within said fluid in said container;

drawing fluid through said at least one open end;

expelling said fluid through said vanes; and shearing fluid as it passes through said vanes, shearing and dispersing particulate material within said fluid, thereby homogenizing said fluid.

5. The method in accordance with claim 4 wherein said vanes extend in a direction generally along said axis.

6. The method in accordance with claim 4 wherein said support is generally positioned in a plane and said vanes extend away from said support in at least one direction generally perpendicular to said plane.

7. The method in accordance with claim 4 wherein said fluid comprises paint.

8. A method of mixing fluid comprising:

isolating a fluid to be mixed in a container;

providing a mixing device comprising a shaft extending along an axis, a support mounted for rotation by said shaft, a number of vanes mounted for rotation with said support, said vanes having a first end and a second end, said vanes having an outer edge and an inner edge, one or more of said vanes having a portion of said inner edge at said first end thereof extending inwardly towards said axis a first distance and a portion at other than said first end extending inwardly towards said axis a second distance greater than said first distance, at least a portion of said inner edge of one or more of said vanes extending inwardly toward said axis no more than about 0.3 of the distance between the outer edge of said vane and said axis, said device having at least one generally open end into which fluid may be drawn into an interior space defined at least in part by said vanes;

positioning said device in said container containing fluid to be mixed;

rotating said mixing device within said fluid in said container;

drawing fluid through said at least one open end;

expelling said fluid through said vanes; and shearing fluid as it passes through said vanes, shearing and dispersing particulate material within said fluid, thereby homogenizing said fluid.

9. The method in accordance with claim 8 wherein said fluid comprises paint.

10. A method of mixing fluid comprising:

isolating a fluid to be mixed in a container;

providing a mixing device comprising a shaft extending along an axis, a support mounted for rotation by said shaft, a number of vanes having a first end and a second end, said vanes positioned radially outward from said axis and mounted for rotation with said support, said first ends of said vanes defining a first opening therebetween and said second ends defining a second opening therebetween, said first opening being larger than said second opening, and portions of one or more of said vanes positioned no more than about 0.3 inches apart;

positioning said device in said container containing fluid to be mixed;

rotating said mixing device within said fluid in said container;

drawing fluid into at least one of said first or second openings defined by said vanes;

expelling said fluid through said vanes; and straining undispersable materials with said vanes during said rotating step.

11. The method in accordance with claim 10 wherein said vanes have an inner edge, said inner edge of one or more of said vanes sloping inwardly towards said axis in a direction from said first end to said second end.

12. The method in accordance with claim 10 wherein said fluid comprises paint.

13. The method in accordance with claim 10 including the step of providing vanes which are curved between an inner edge and an outer edge thereof.

14. A method of mixing fluid comprising:

isolating a fluid to be mixed in a container;

providing a mixing device comprising a shaft extending along an axis, a support mounted for rotation by said shaft, a number of vanes mounted for rotation with said support, said vanes having a first end and a second end, said vanes having an outer edge and an inner edge, said inner edge of one or more of said vanes positioned closer to said axis at said first end than at said second end thereof, and portions of one or more of said vanes positioned no more than about 0.3 inches apart; said device having at least one generally open end into which fluid may be drawn into an interior space defined at least in part by said vanes;

positioning said device in said container containing fluid to be mixed;

rotating said mixing device within said fluid in said container;

drawing fluid through said at least one open end;

expelling said fluid through said vanes; and straining undispersable materials with said vanes during said rotating step.

15. The method in accordance with claim 14 wherein said fluid comprises paint.

16. The method in accordance with claim 14 wherein said inner edge of one or more of said vanes slope inwardly towards said axis moving in a direction from said second end to said first end of said vane.

17. A method of mixing fluid comprising:

isolating a fluid to be mixed in a container;

providing a mixing device comprising a shaft extending along an axis, a support mounted for rotation by said shaft, a number of vanes mounted for rotation with said support, said vanes having a first end and a second end, said vanes having an outer edge and an inner edge, one or more of said vanes having a portion of said inner edge at said first end thereof extending inwardly towards said axis a first distance and a portion at other than said first end extending inwardly towards said axis a second distance greater than said first distance, and portions of one or more of said vanes positioned no more than about 0.3 inches apart; said device having at least one generally open end into which fluid may be drawn into an interior space defined at least in part by said vanes;

positioning said device in said container containing fluid to be mixed;

rotating said mixing device within said fluid in said container;

drawing fluid through said at least one open end;

expelling said fluid through said vanes; and straining undispersable materials with said vanes during said rotating step.

18. The method in accordance with claim 17 wherein said fluid comprises paint.

19. A method of mixing fluid comprising:

isolating a fluid to be mixed in a container;

providing a mixing device comprising a shaft extending along an axis, a support mounted for rotation by said shaft, a number of vanes having a first end and a second end and an outer edge and an inner edge, said vanes positioned radially outward from said axis and mounted for rotation with said support, said first ends of said vanes defining a first opening therebetween and said second ends defining a second opening therebetween, said first opening being larger than said second opening, said inner edge of said vanes at said first end extending inwardly towards said axis no more than about 0.4 of the distance between the outer edge of said vanes and said axis and extending inwardly towards said axis no more than about 0.7 of the distance between the outer edge of said vanes and said axis at said second end;

positioning said device in said container containing fluid to be mixed;

rotating said mixing device within said fluid in said container, whereby said fluid reaches a high radial velocity and is sheared as it impacts said vanes, and whereby a surface area of said vanes is enlarged at one or more areas thereof, providing for an increased fluid flow and mixing rate.

20. The method in accordance with claim 19 wherein said fluid comprises paint.

21. A method of mixing fluid comprising:

isolating a fluid to be mixed in a container;

providing a mixing device comprising a shaft extending along an axis, a support mounted for rotation by said shaft, a number of vanes mounted for rotation with said support, said vanes having a first end and a second end thereof, said vanes having an outer edge and an inner edge, said inner edge of one or more of said vanes positioned closer to said axis at said first end than at said second end, said inner edge of said vanes at said second end extending inwardly towards said axis no more than about 0.4 of the distance between the outer edge of said vanes and said axis and extending inwardly towards said axis no more than about 0.7 of the distance between the outer edge of said vanes and said axis at said first end;

positioning said device in said container containing fluid to be mixed;

rotating said mixing device within said fluid in said container, whereby said fluid reaches a high radial velocity and is sheared as it impacts said vanes, and whereby a surface area of said vanes is enlarged at one or more areas thereof, providing for an increased fluid flow and mixing rate.

22. The method in accordance with claim 21 wherein said fluid comprises paint.

23. The method in accordance with claim 21 including the step of providing vanes which are curved between said inner edge and said outer edge thereof.

* * * * *